United States Patent [19]

Koseki et al.

[11] Patent Number: 4,791,453

[45] Date of Patent: Dec. 13, 1988

[54] RECORDING APPARATUS

[75] Inventors: Yasufumi Koseki; Seiichi Suzuki; Utami Soma; Harufumi Yamashita, all of Hachioji, Japan

[73] Assignee: Konishiroku Photo Industry Co., Ltd., Tokyo, Japan

[21] Appl. No.: 23,455

[22] Filed: Mar. 9, 1987

[30] Foreign Application Priority Data

Mar. 14, 1986 [JP] Japan ..... 61-55128
Mar. 19, 1986 [JP] Japan ..... 61-59410
Mar. 19, 1986 [JP] Japan ..... 61-59411

[51] Int. Cl.[4] ..... G03G 21/00
[52] U.S. Cl. ..... 355/14 R; 355/14 FU
[58] Field of Search ..... 355/3 R, 3 FU, 14 FU, 355/14 R; 219/216

[56] References Cited

U.S. PATENT DOCUMENTS 3,791,732 2/1974 Mihalik et al. ..... 355/3 FU X
3,881,085 4/1975 Traister ..... 355/3 FU X
4,090,787 5/1978 Hubbard et al. ..... 355/14 R
4,113,375 9/1978 Murata et al. ..... 355/3 FU X
4,243,313 1/1981 Masuda et al. ..... 355/14 R
4,618,247 10/1986 Tsuji ..... 355/3 FU X
4,627,714 12/1986 Nozaki ..... 355/3 FU X

FOREIGN PATENT DOCUMENTS 2033840 5/1980 United Kingdom .

*Primary Examiner*—Fred L. Braun
*Attorney, Agent, or Firm*—Frishauf, Holtz, Goodman & Woodward

[57] ABSTRACT

A recording apparatus includes: a main switch for turning on/off a power source; a sub switch for turning on/off the power source by an open/close operation of an open/close portion of the apparatus; a memory for storing recording conditions which are set when the power source is turned off; and circuitry which sets a recording condition for initializing the recording conditions to predetermined values when the power switch is turned on after being turned off by the main switch, and for reading out and resetting the recording conditions stored in the memory when the power source is turned on after being turned off by the sub switch, thereby recording by an electrophotographic process in accordance with the recording conditions set by the circuitry for setting the recording condition.

6 Claims, 4 Drawing Sheets

RECORDING APPARATUS

BACKGROUND OF THE INVENTION

1. Field Of The Invention

The present invention relates to an electro-photographic recording apparatus such as a printer and, more particularly, to a recording apparatus which stores recording conditions such as recording number, density, and magnification (to be referred to as "recording conditions") when a power source is turned off, and resets the stored recording conditions when the power source is turned on again.

2. Description Of The Prior Art

Recently, safety standards in various countries (such as UL, CSA, and IEC) have become more strict, and a demand has arisen for a safe mechanical structure by which a user does not touch powered electrical components, live wires, and the like. On the other hand, because of tendencies toward image maintenance and mono coloring of a copying machine, units in a machine must be easily detachable by a user. Since most of the units have electrical components therein, electrical contacts (connectors) are exposed when the units are detached. A structure by which the user never touches electrical components, even when the unit is detached, is preferred to satisfy the safety standards, although it is structurally difficult and requires much cost. Therefore, some copying machines have a structure in which a power source is turned off when a door of the machine is opened. However, when the power source of the machine is turned off, all the recording conditions at that time are cleared. In order to continue the copying operation thereafter, the user must turn on the power source and reset all the recording conditions, resulting in a cumbersome operation. For this reason, some newly developed copying machines store recording conditions in a nonvolatile memory or a battery back up memory when a door is opened to turn off a power source, and reset the stored recording conditions when the power source is turned on again.

In copying machines of this type, a main switch and a door switch are independently provided as power source switches, and when either of these switches is turned off, recording conditions immediately before that are stored and are reset when the power source is turned on again.

For example, when a door is opened to remove a jammed sheet of paper, a power source is turned off, and when the door is closed after removing the sheet, the power source is turned on to reset the recording conditions immediately before the door was opened. Therefore, the recording conditions conveniently need not be set again.

However, in this case, when a copying operation is to be performed after a long period of time since a previous copying operation is completed and a power source is turned off, the recording conditions for the previous copying operation are reset when the power source is turned on. Therefore, an operator must initialize or set desired conditions every time the power source is turned on, and this cumbersome setting operation leads to poor operability.

SUMMARY OF THE INVENTION

The present invention has been made in consideration of the above situation and has as its object to improve operability of setting recording conditions in a recording apparatus using an electrophotographic process.

In order to achieve the above object, according to a first aspect of the present invention, when a power source is turned off by a main switch, recording conditions are initialized after the power source is turned on again, and when the power source is turned off by a sub switch, the recording conditions that are set immediately before are reset after the power switch is turned on again.

According to a second aspect of the present invention, in a recording apparatus which stores recording conditions immediately before a power source is turned off, and which resets the stored recording conditions after the power source is turned on again, if a temperature of a fixing device is below a predetermined value when the power source is turned on, the recording conditions are initialized.

According to a third aspect of the present invention, recording conditions are initialized when a time interval from the turn-on of the power source to reaching of a fixing device to a temperature capable of fixing exceeds a predetermined time.

DETAILED DESCRIPTION OF THE PREFERRED EMBODIMENTS

Preferred embodiments of a recording apparatus according to the present invention will now be described in detail with reference to the accompanying drawings.

Figure 1:
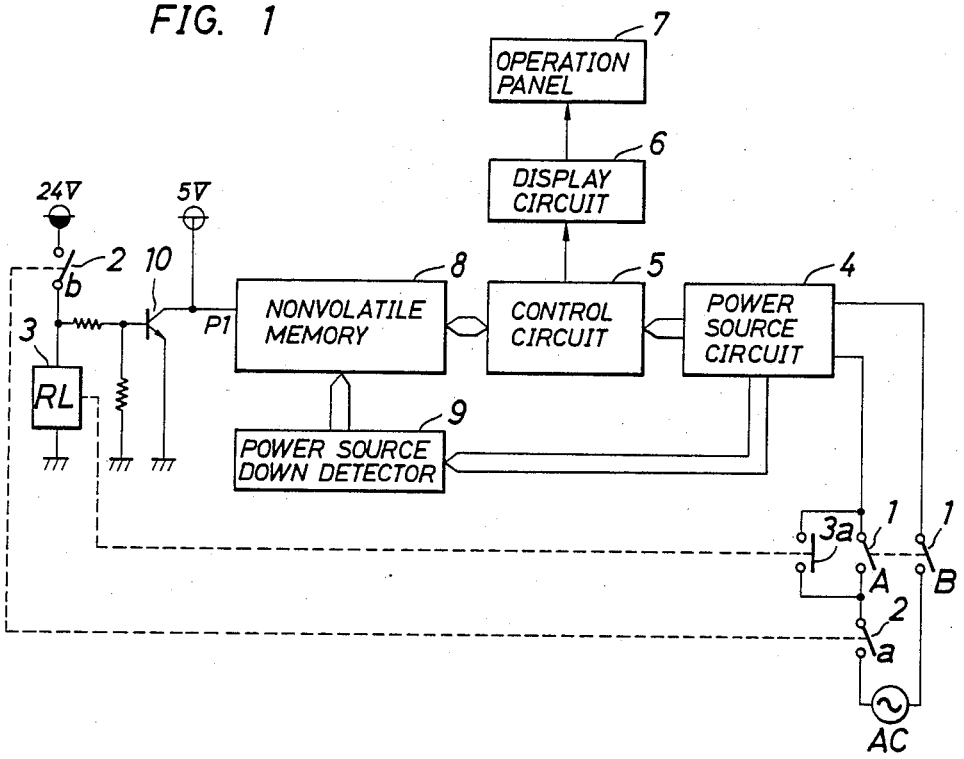
FIG. 1 is a block diagram of a recording apparatus according to an embodiment of the present invention.

FIG. 1 is a block diagram of a recording apparatus according to an embodiment of the present invention.

In FIG. 1, reference numeral 1 denotes a seesaw type main switch having two contacts A and B. When the main switch 1 is depressed to the on side, both the contacts A and B are turned on. When the depressing finger is released from the main switch 1, the switch is set at a middle point and the contact B remains on but the contact A is turned off. When the main switch 1 is depressed to the off side, both the contacts A and B are turned off. Reference numeral 2 denotes a door switch of a door which is opened/closed to remove a jammed sheet of paper. The door switch 2 has contacts a and b which are turned on when the door is closed. When the contact b is turned on, a relay 3 is energized to turn on a contact 3*a*. Therefore, since the contact 3*a* is turned on when the main switch is set at the middle point to turn off the contact A, an AC power source is supplied.

Reference numeral 4 denotes a power source circuit; 5, a control circuit including a CPU; 6, a display circuit for displaying recording conditions on an operation panel 7; 8, a nonvolatile memory for storing the recording conditions and an on/off state of the door switch 2; 9, a power source down detector for disconnecting the nonvolatile memory 8 from an external circuit when a power source voltage decreases below a predetermined voltage; and 10, a switching transistor.

Figure 2:
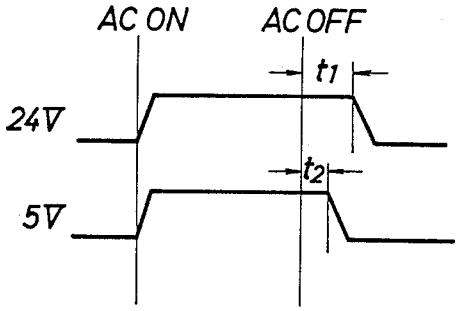
FIG. 2 is a view showing a time relationship between ON/OFF of an AC line power source and ON/OFF of each power source.

When an AC power supply to the power source circuit 4 is cut off, falls of a 24 V power source voltage applied to the relay 3 and a 5 V power source voltage applied to the switching transistor 10 have time delays t1 and t2 as shown in FIG. 2. A threshold level is set at a value (e.g., 4.5 V or more) so that the power source down detector 9 is operated at a timing t which satisfies a condition of $t1>t>t2$ and a voltage of the 5 V power source during the operation is determined to be at "H (High)" level. The nonvolatile memory 8 stores a voltage level of the P1 port thereof during the operation of the power down detector 9. Therefore, when the power source is turned off by the main switch 1 and the power source down detector 9 is operated, the relay 3 is turned on and the switching transistor 10 is conducted because the 24 V and 5 V power sources are in a supply state. Thus, the P1 port is set to be at "L (Low)" level. On the contrary, when the power source is turned off by the door switch 2, the contact b of the door switch 2, for connecting the 24 V power source and the relay 3, is turned off. Therefore, when the power source down detector 9 is operated, the relay 3 is turned off and the switching transistor 10 is cut off, so that the P1 port is set to be at "H" level.

Therefore, when the AC power source is supplied again, voltage level data of the P1 port of the nonvolatile memory 8 can be checked to determine whether the power source is turned off by the main switch 1 or the door switch 2.

Figure 3:
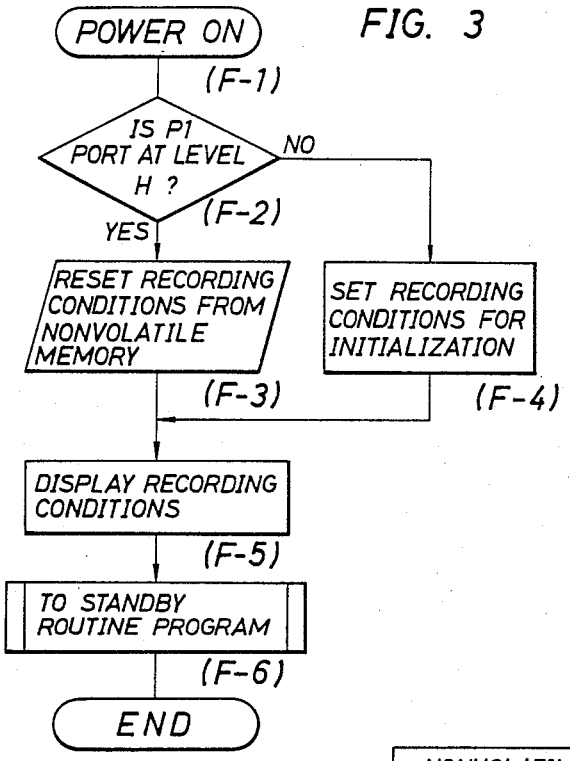
FIG. 3 is a flow chart showing a setting operation of recording conditions of the recording apparatus in FIG. 1.

An operation of the above embodiment will now be described with reference to the flow chart of FIG. 3.

First, the main switch 1 is turned on or the door is closed to turn on the door switch 2, so that the power source circuit 4 is turned on (F-1). Prior to this operation, the nonvolatile memory 8 stores recording conditions obtained before the main switch 1 or the door switch 2 was turned off previously. In addition, the P1 port of the nonvolatile memory 8 stores "H" or "L" level.

Then, the control circuit 5 receives level data of the P1 port of the nonvolatile memory 8 and determines whether level data is at "H" or "L" level (F-2). If level data is at "H" level, the control circuit 5 resets the recording conditions stored in the nonvolatile memory 8 (F-3). As has been described above, in this case, the power source is turned off by the door switch 2, so that the control circuit 5 determines that the power source is turned off during a copying operation for, e.g., removing a jammed sheet of paper, and resets the recording conditions previously stored in the nonvolatile memory 8. The control circuit 5 determines that the power source is turned off by the main switch 1 if the P1 port of the nonvolatile memory 8 is not at "H" level and that the previous copying operation is completed. In this case, the control circuit 5 sets preprogrammed recording conditions (e.g., the number of copies=1, magnification=1:1, density=normal) for initialization (F-4).

Finally, the display circuit 6 displays the recording conditions on the operation panel 7 (F-5), and the flow advances to a standby routine program (F-6). In this program, all checks such as copying sheets of paper and cassettes before the flow advances to a copy process are performed.

According to the embodiment described above, when the power source is turned off by the door switch 2 for, e.g., removing a jammed sheet of paper, the previous recording conditions are set when the power source is turned on again. However, when the power source is turned off by the main switch 1 after the copying operation is completed, the recording conditions are initialized when the power source is turned on again, so that a cumbersome setting operation need not be performed by a user.

In the above embodiment, a description has been made with reference to the door switch associated with the door. However, a switch may be provided to, e.g., a door of an automatic document feeder so as to serve as a door switch. Furthermore, in a copying machine having a clam shell type door, a switch which is turned on/off by opening/closing of an upper unit is used as a door switch of the present invention. In addition, a switch which is turned off when a feed unit or a power supply unit is extracted may be used.

Note that, although depending on a feature of a recording apparatus, the recording conditions include an ADF mode, a sorter mode, a trimming mode, a masking mode, and a both surface copying mode, and the like in addition to the number of copies, density, and magnification described above. In addition, a printer which is used as a computer terminal includes an on line/off line mode, a normal print/high speed print mode, and the like.

A second embodiment of the present invention will now be described with reference to FIGS. 4 and 5.

Figure 4:
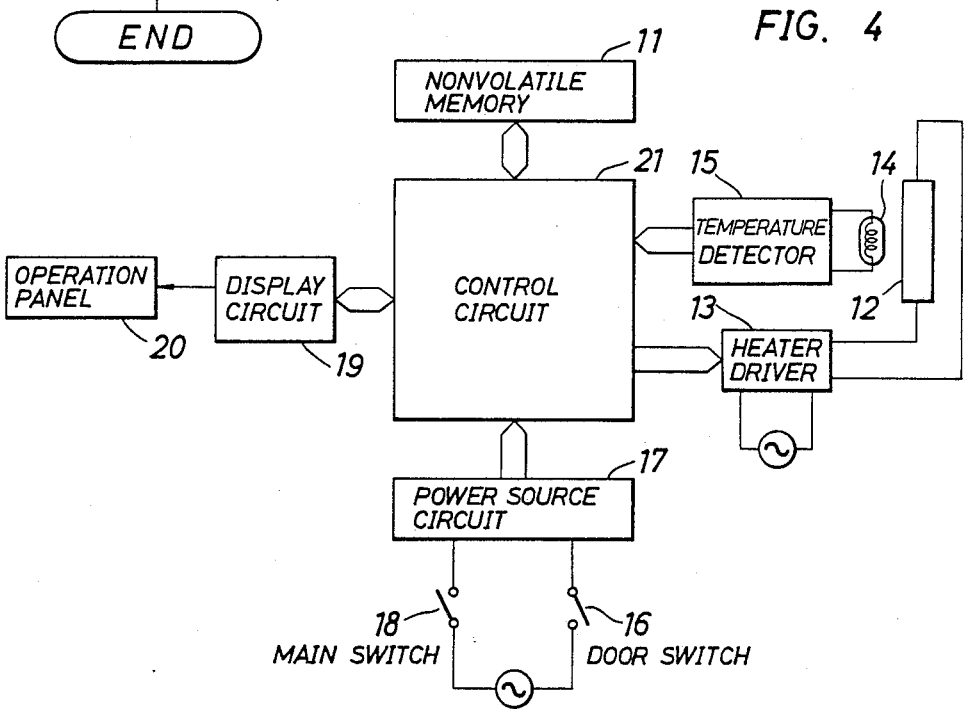
FIG. 4 is a block diagram of a recording apparatus according to a second embodiment of the present invention.
Figure 5:
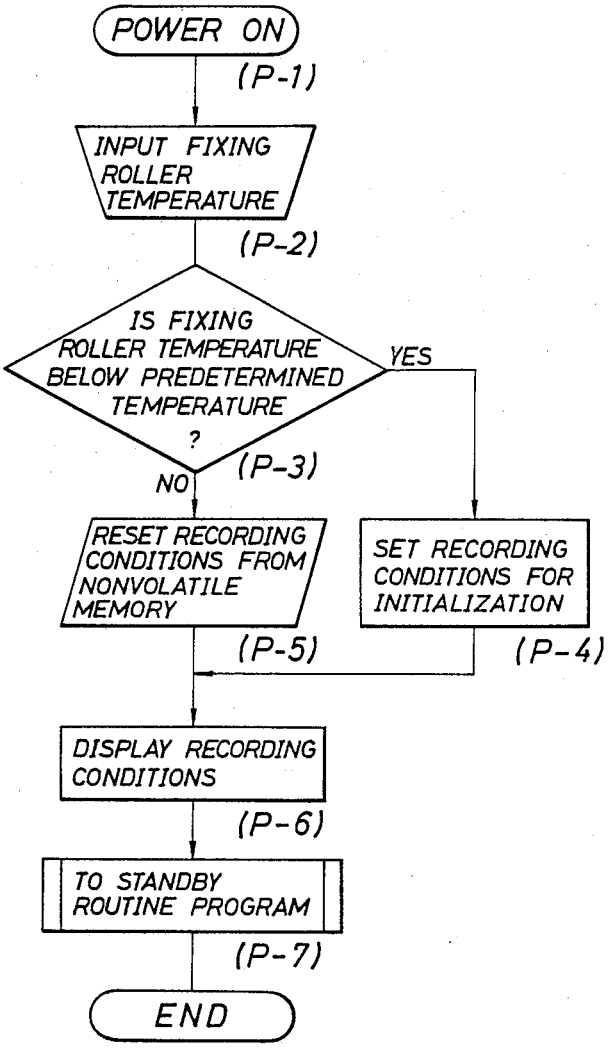
FIG. 5 is a flow chart showing a setting operation of recording conditions of the recording apparatus in FIG. 4.

FIG. 4 is a block diagram of a recording apparatus according to the second embodiment of the present invention.

In FIG. 4, reference numeral 11 denotes a nonvolatile memory for storing recording conditions; 12, a fixing roller having a heater lamp therein; 13, a heater driver for driving the heater lamp; 14, a temperature sensor such as a thermistor for detecting a surface temperature of the fixing roller 12; 15, a temperature detector for processing a signal from the temperature sensor 14; 16, a door switch for turning off the power source circuit 17 when a door of the recording apparatus is opened; 18, a main switch for turning on/off the power source circuit 17; 19, a display circuit for displaying recording conditions on an operation panel 20; and 21, a control circuit including a CPU.

An operation of the second embodiment will be described below with reference to the flow chart of FIG. 5.

First, the main switch 18 is turned on to turn on the power source circuit 17 (P-1). In the circuit shown in FIG. 4, both the door switch 16 and the main switch 18 are turned on to turn on the power source circuit 17. However, since the door is normally closed, the power source circuit 17 is turned on by turning on the main switch 18. Prior to this, the nonvolatile memory 11 stores the recording conditions obtained when the main switch 18 and the door switch 16 were turned off previously.

Then, the temperature sensor 14 detects a surface temperature of the fixing roller 12, and a temperature signal is input in accordance therewith (P-2). In accordance with the temperature signal, the control circuit 21 determines whether the surface temperature of the fixing roller 12 is over a predetermined temperature (e.g., 50° C.) (P-3). If the temperature is below the predetermined temperature, the control circuit 21 sets the preprogrammed recording conditions (such as the number of copies = 1, magnification = 1:1, and density = normal) (P-4). If the surface temperature of the fixing roller 12 is not below the predetermined temperature, the control circuit 21 reads out the prestored recording conditions from the nonvolatile memory 11 and resets them as the recording conditions (P-5).

It is known that about 15 minutes are required for the fixing roller 12 to reach the surface temperature of 50° C. since the heater lamp is turned off. A duration of 15 minutes represents a time longer than that required for removing a jammed sheet of paper. Therefore, the copying operation can be assumed to be completed if the heater lamp is turned off for 15 minutes. Therefore, in the second embodiment, when the surface temperature of the fixing roller 12 is below 50° C., the control circuit 21 determines that the previous copying operation is completed and sets the recording conditions for initialization.

Finally, the display circuit 19 displays the recording conditions on the operation panel 20 (P-6), and the flow advances to the standby routine program (P-7). In this program, all checks such as copying sheet of paper and cassette checks before the flow advances to the copying process are performed.

Thus, according to the present invention, when the power source is turned off for a short period of time for, e.g., removing a jammed sheet of paper, the previous recording conditions are set after the power source is turned on again. However, when the power source is turned on after a long period of time since the power source is turned off after the copying operation is completed, the recording conditions are initialized. Therefore, cumbersome setting operation such as resetting need not be performed.

A third embodiment of the recording apparatus according to the present invention will now be described below.

In the second embodiment, an operation state of the copying machine is determined by detecting the surface temperature of the fixing roller 12 when the power source circuit 17 is turned on. However, in the third embodiment, a time required for a copying machine to complete warming up is measured, thereby determining the operation state of the copying machine.

Figure 6:
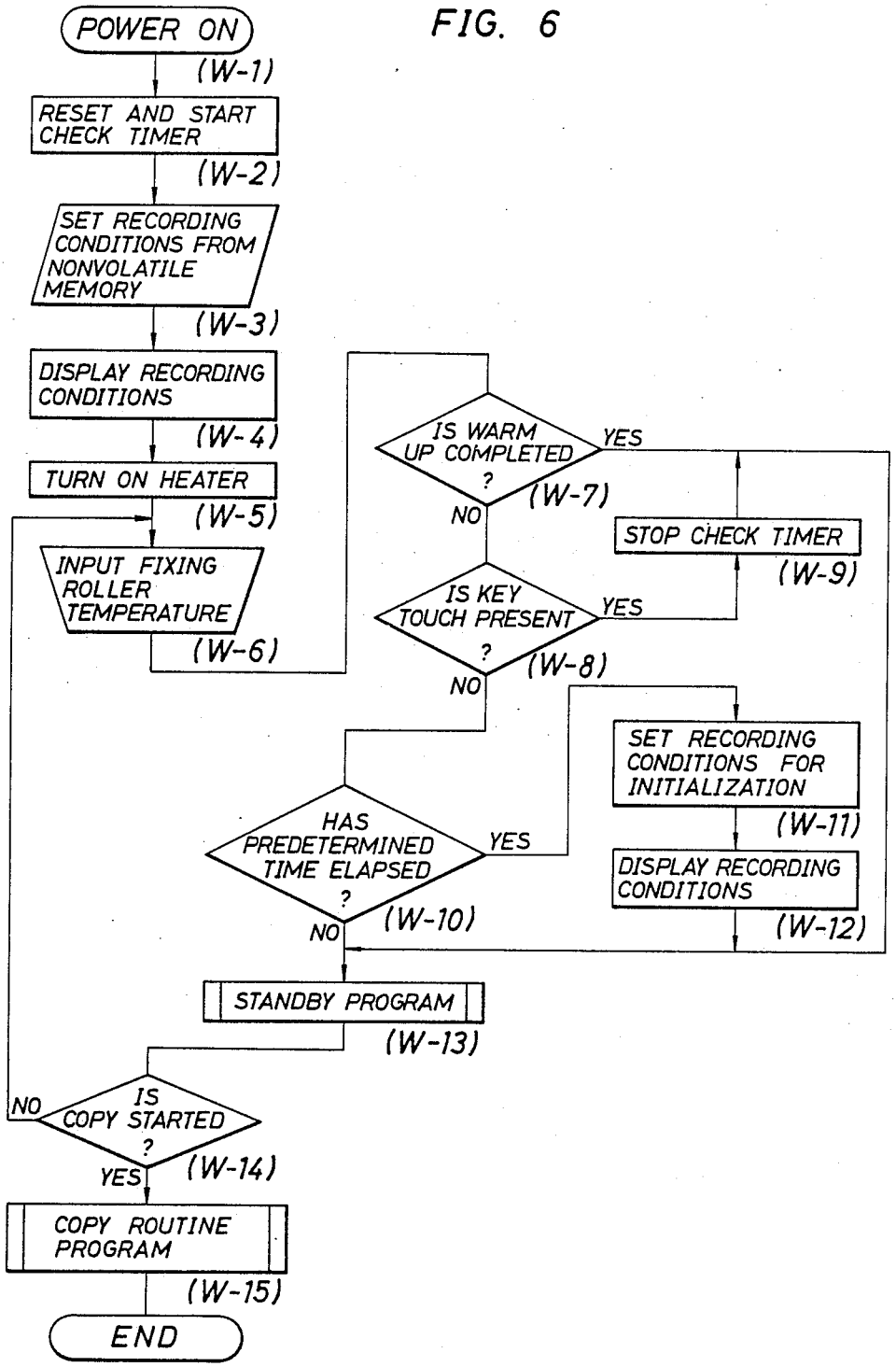
FIG. 6 is a flow chart showing an operation of a recording apparatus according to a third embodiment of the present invention.

Therefore, an arrangement of the third embodiment is the same as that of the second embodiment, and an operation thereof will be described with reference to the flow charts of FIGS. 4 and 6.

First, the main switch 18 is turned on to turn on the power source circuit 17 (W-1). As has been described above, in the circuit shown in FIG. 4, both the door switch 16 and the main switch 18 are turned on to turn on the power circuit 17. However, since the door is normally closed, the power source circuit 17 is turned on by turning on the main switch 18. Prior to this, the nonvolatile memory 11 stores the recording conditions obtained when the main switch 18 or the door switch 16 was turned off previously.

Then, a check timer provided in the control circuit 21 is reset and started (W-2), the stored recording conditions are read out from the nonvolatile memory 11 and reset (W-3), and the display circuit 19 displays the recording conditions on the operation panel 20 (W-4).

Thereafter, the heater driver 13 is turned on (W-5), the temperature sensor 14 detects the surface temperature of the fixing roller 12, and a temperature signal is input to the control circuit 13 (W-6). In accordance with the temperature signal, the control circuit 21 determines whether the temperature of the fixing device has reached the temperature capable of fixing, i.e., warming up is completed (W-7). If warming up is completed, the flow advances to the standby program (W-13). In this program, all checks such as a copying sheet of paper and cassette checks before the flow advances to the copying process are performed.

If warming up is not completed, the control circuit 21 determines whether an operation of the operation panel 20, i.e., key touch is present (W-8). If key touch is present, the control circuit 21 stops measurement of the check timer (W-9), and if key touch is not present, the control circuit 21 determines whether the time measured by the check timer exceeds the predetermined time (e.g., 30 sec) (W-10). If the time exceeds the predetermined time, the control circuit 21 sets the preprogrammed recording conditions (e.g., the number of copies = 1, magnification = 1:1, and density = normal) for initialization instead of those set in step (W-3) (W-11). The display circuit 19 displays the recording conditions on the operation panel 20, and the flow advances to the standby program (W-13).

Finally, when a copy start button is depressed (W-14), the flow advances to a copy routine program for performing a series of electrophotographic processing (W-15). If the start button is not depressed, the flow returns to the step (W-6), and the same operation is repeated.

As has been described above, according to the present invention, when the power source is turned off for a short period of time for, e.g., removing a jammed sheet of paper, the previous recording conditions are set after the power source is turned on again. However, when the power source is turned on after a long period of time since the power source is turned off after the copying operation is completed, the recording conditions are initialized to those before warming up is completed. Therefore, a cumbersome set operation such as reset is not required.

We claim:

1. A recording apparatus comprising:

memory means for storing recording conditions already set when a power source is turned off;

temperature detecting means for detecting a temperature of a fixing device when the power source is turned on;

means for determining whether the temperature detected by said temperature detecting means is over a predetermined temperature; and recording condition set means for initializing the recording conditions to predetermined values when said detected temperature is below said predetermined temperature, and for reading out and resetting the recording conditions stored in said memory means when said detected temperature is over said predetermined temperature, thereby recording by an electrophotographic process in accordance with the recording conditions set by said recording condition set means.

2. An apparatus according to claim 1, wherein said memory means is a nonvolatile memory.

3. An apparatus according to claim 1, wherein a determining operation by said determining means is stopped and recording is effected in accordance with the input recording conditions when the recording conditions are input from an operation portion by a key operation.

4. A recording apparatus comprising:

memory means for storing recording conditions already set when a power source is turned off;

temperature detecting means for detecting a temperature of a fixing device since the power source is turned on;

measuring means for measuring a length of time which has passed since the power source was turned on;

means for determining a time required for the temperature detected by said temperature detecting means to reach a temperature capable of fixing;

recording condition set means for initializing recording conditions to predetermined values when said required time exceeds a predetermined time, and for reading out and resetting the recording conditions stored in said memory means when said required time is below said predetermined time, thereby recording by an electrophotographic process in accordance with the recording conditions set by said recording condition set means.

5. An apparatus according to claim 4, wherein said memory means is a nonvolatile memory.

6. An apparatus according to claim 4, which stops a determining operation by said determining means and records in accordance with the input recording conditions when the recording conditions are input from an operation portion by a key operation.

* * * * *